United States Patent [19]

Patterson et al.

[11] 4,217,383

[45] Aug. 12, 1980

[54] FOAM COATED CARPET PRIMARY BACKING MATERIAL

[75] Inventors: Henry G. Patterson; Stanley A. Shemchek, both of Dalton; Robert G. Doone, Summerville; Henry B. Christopher, Dalton, all of Ga.

[73] Assignees: Textile Rubber & Chemical Company, Inc., Dalton, Ga.; Exxon Research & Engineering Co., Florham Park, N.J.

[21] Appl. No.: 2,204

[22] Filed: Jan. 9, 1979

Related U.S. Application Data

[63] Continuation of Ser. No. 861,990, Dec. 19, 1977, abandoned.

[51] Int. Cl.[2] ..... B32B 33/00

[52] U.S. Cl. ..... 428/95; 428/17; 428/96; 156/72

[58] Field of Search ..... 428/17, 95, 96; 156/72

[56] References Cited

U.S. PATENT DOCUMENTS

| | | | |
|---|---|---|---|
| 3,385,751 | 5/1968 | Willard | 428/95 |
| 3,811,922 | 5/1974 | Clark | 428/96 |
| 4,035,533 | 7/1977 | Chambley | 428/95 |

*Primary Examiner*—Marion McCamish

*Attorney, Agent, or Firm*—Jones, Thomas & Askew

[57] ABSTRACT

A tufted carpet product including a woven or non-woven primary backing material, a layer of foam compound adhered to the undersurface of said primary backing, rows of yarn elements tufted through the primary backing and the layer of foam compound to form a face of yarn on the upper surface of the primary backing and loop backs on the undersurface of the backing and foam compound, and optionally a thin layer of adhesive compound applied to the loop backs of the yarn elements.

4 Claims, 1 Drawing Figure

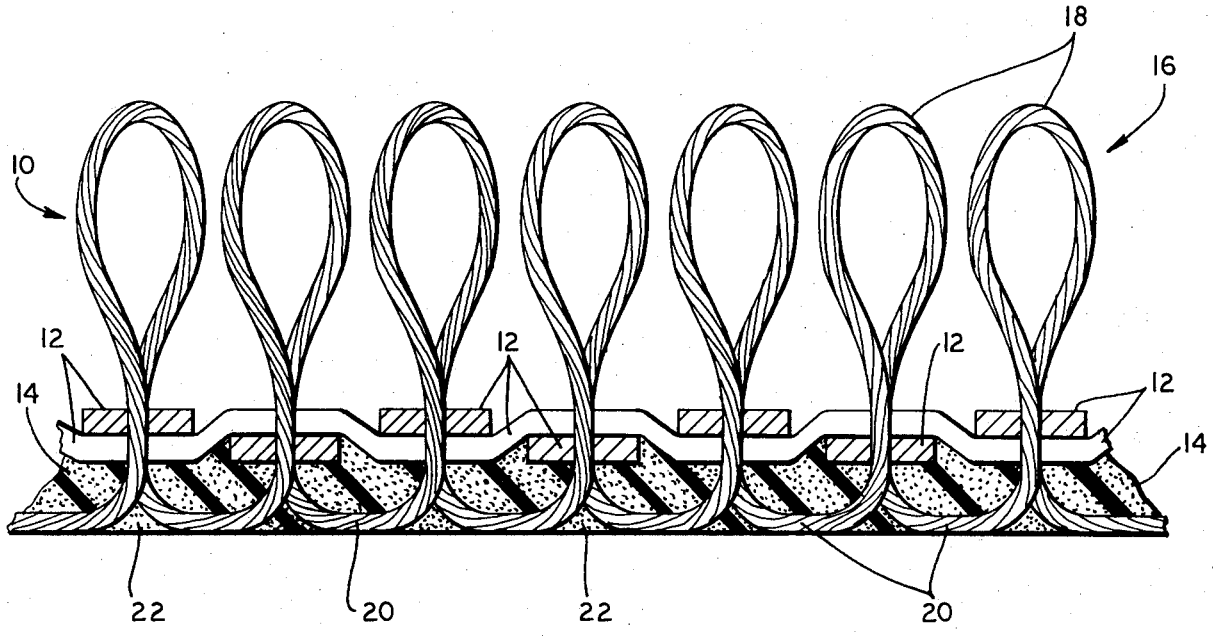
18
16
10
12
12
12
12
14
14
22
20
22
20

FOAM COATED CARPET PRIMARY BACKING MATERIAL

This is a continuation of application Ser. No. 861,990, filed Dec. 19, 1977, now abandoned.

The present invention relates to a primary carpet backing material and to a tufted carpet constructed from such a material. More particularly, the invention concerns a primary backing which includes a layer of foam compound on the undersurface thereof as shown in the Figure.

The majority of all tufted carpet is manufactured today by tufting a carpet yarn into a synthetic primary backing material. Typically, the primary backing material is a woven flat strand polypropylene material and is passed through a tufting machine where yarn elements are stitched 'through this primary backing material. Following this tufting operation, a coating of latex material is applied to the back of the yarn loops to anchor the yarn elements in place in the backing, add dimensional stability to the carpet, and provide a smooth undersurface for the carpet. The addition of this back coating of latex material, however, requires extended drying of the carpet product in heated ovens over relatively long periods of time. The length of time required for drying the conventionally manufactured tufted carpet produces obvious operating inefficiences.

Accordingly, is is an object of the present invention to provide a tufted carpet product which is more efficient in construction.

A further object of the present invention is to provide a carpet backing material which may be tufted rapidly to produce a finished product without further drying and curing steps.

These and other objects, features and advantages of the present invention will become apparent from a review of the following detailed description of preferred embodiments of the present invention and the accompanying drawing wherein the FIGURE is a cross-sectional view of the tufted carpet product of the present invention.

DETAILED DESCRIPTION OF THE INVENTION

The present invention is particularly suited for use in the manufacture of an all synthetic tufted carpet product such as those products conventionally referred to as indoor-outdoor carpet having an appearance similar to grass. However, it should be clearly understood that the present invention may also be used in the construction of other types of tufted carpet products, such as those products employing all natural materials, i.e. jute, cotton and wool. It should also be understood that the present invention may be used together with both woven and non-woven backing materials. A typical carpet construction today includes a woven flat strand polypropylene primary carpet backing material, such as disclosed in Rhodes U.S. Pat. No. 3,110,905. In addition, synthetic polypropylene primary backing is frequently pre-coated with a thin layer of adhesive material according to Patterson U.S. Pat. No. 3,864,195. The present invention is particularly well suited for use with both of these types of primary backing materials.

According to the present invention a primary carpet backing material is coated on its undersurface with a foam compound. The compound may be either a natural or synthetic latex rubber material, or a blend thereof, or a urethane material. The nature and composition of the foam compound is conventional except for the inclusion of a lubricant to enhance tuftability of the backing and foam compound. Several ingredients or combination of ingredients produce the desired degree of lubrication when blended into the compound. These ingredients include silicone compounds, glycols such as polyethylene glycol, diethylene glycol, triethylene glycol and the like and various stearates such as potassium stearate, calcium stearate, zinc stearate and the like. A preferred lubricant is diethylene glycol.

The glycol is added in a quantity ranging from about 5 to about 15 parts by weight per 100 parts by weight of rubber or urethane compound. The stearates may be added alone or in combination with the glycol in the range of about 5 to about 15 parts by weight per 100 parts by weight of rubber or urethane compound.

The foam compound, if coated directly onto the primary backing material, may be formulated in a conventional fashion to have good specific adhesion to woven flat strand polypropylene, to be fire retardant and to be quite flexible when dry.

Prior to coating onto the primary backing, the foam compound is frothed in a conventional Oakes foam machine to standard density. The foam compound is then coated onto the undersurface of the primary backing to produce a cross-sectional thickness of foam and backing of between 35 and 45 mils, or a foam thickness of between 20 and 35 mils. The weight of foam compound applied to the carpet backing is in the range of 3 to 7 ounces per square yard of backing material, with 5 ounces being a preferred weight of foam compound per square yard of backing.

After coating the foam compound on to the backing, the backing is passed immediately into a heated forced air oven at a temperature which is sufficiently hot to evaporate any moisture in the compound and cure the foam compound to a finished and dry layer. One significant advantage of the present invention is that the oven may be operated at temperatures which are elevated over normal drying oven temperatures. When drying a standard tufted carpet product, the temperature of the oven has to be limited in order to preserve the appearance and feel of the face yarn. Since the backing has not been tufted with yarn when it is coated and dried in the present invention, the oven may be operated at higher temperatures. Operating efficiencies and speeds normally result from an increase in the oven temperature.

It has been found that when the foam compound is coated onto a flat strand woven synthetic backing which has been pre-coated according to Patterson U.S. Pat. No. 3,864,195 excellent adhesion to the synthetic backing is obtained. For that reason, it is preferred that a pre-coated synthetic backing material be used as the base material. According to the Patterson patent a very thin layer of adhesive material is coated onto the backing material and then dried and cured to reduce ravelling of the backing and increase adhesion of compounds to the backing material.

After drying and curing of the foam compound in an oven according to the present invention, the backing is passed through a standard carpet tufting machine and yarn is tufted through the foam compound and through the primary backing material. Due to the resiliency of the foam compound the loop backs of face yarn compress the foam compound beneath the loop back. As a consequence, the back surface of the tufted material is relatively smooth and does not present the typical irregular texture which is produced by tufting into a standard primary backing material. It should be clearly understood that, when practising the preferred embodiment of the present invention, the tension on the tufting machine is adjusted so that the foam compound is compressed beneath the loop backs to produce a relatively smooth back for the tufted product.

After tufting, the carpet product is complete for many applications. It has been found that the foam compound grips the face yarn as it passes through the foam compound to such a significant degree that the tufted product has utility in many floor covering applications. When the tufted product is glued down to a floor surface, as is often done with indoor-outdoor carpet materials, the glue material will both secure the carpet product to the floor surface and also further secure the face yarn in the backing material.

In one alternative embodiment of the present invention, the tufted backing is passed through a coating operation where a very thin layer of adhesive compound is applied to the loop backs. Since the loop backs have compressed the foam compound and therefore present a relatively smooth surface with the tops of the loop backs at substantially the same level as the uncompressed foam compound between adjacent loop backs, the adhesive material may be applied to fill the depressions around the loop backs (where the adhesive is most effective) and may be doctored off the adjacent foam compound surfaces (where it has relatively little effect). The thin back coat layer of adhesive compound may range in weight from 0.1 oz. per square yard to 8 oz. per square yard of backing material. Since a very thin layer is used, it is possible to dry and cure the layer with a very samll oven at very high production rates. The adhesive compound employed in this invention includes standard latex rubber compounds (both natural and synthetic) and urethane compounds. This alternative embodiment need be followed only when increased yarn adhesion is required.

With particular reference to the Drawing, it may be seen that the present tufted carpet product 10 includes a woven primary backing 12, a layer of foam compound 14 on the undersurface thereof and loops of carpet yarn 16 piercing the foam compound and the primary backing to produce a face of yarn 18 and loop backs of yarn 20. As explained earlier, the carpet yarn 16 is tensioned during tufting so that the foam compound is compressed beneath the loop backs 20 and is uncompressed in areas 22 adjacent the loop backs. The Figure does not show the thin back-coat of adhesive material. When such material is added to the back surface of the carpet product, the adhesive material adheres to the loop backs and fills the depressions around the loop backs but is doctored off the surrounding foam compound 22. In addition, indentations created by each loop of yarn as it passes through the foam compound will also be filled with adhesive material to secure the yarn in position.

While this invention has been described in detail with particular reference to preferred embodiments thereof, it will be understood that variations and modifications can be effected within the spirit and scope of the invention as described hereinbefore and as defined in the appended claims.

What is claimed is:

1. Tufted carpet product comprising a primary carpet backing material having an undersurface and an upper surface; a layer of dried tuftable foam compound adhered to the undersurface of the carpet backing material, and loops of carpet yarn extending through the foam compound and the backing material to produce a face yarn on the upper surface of the primary backing and loop backs of yarn on the layer of foam compound, such that the foam compound inwardly of the loop backing is compressed, the foam compound adjacent the loop backs is uncompressed and the exposed surface of the loop backs is at substantially the same level as the uncompressed foam compound adjacent the loop backs so that the undersurface of said carpet product is substantially flat having only slight indentations in said foam compound adjacent each loop back.

2. The tufted carpet product of claim 1 further comprising, adhesive material filling said indentations and adhered to said loop backs, said exposed surface of said uncompressed foam compound being substantially free of said adhesive material.

3. Method of making a tufted carpet product comprising the steps of:

(A) Coating the undersurface of carpet backing material with a layer of tuftable foam compound at a thickness of between 20 and 35 mils and a weight of 3 to 7 ounces per square yard, (B) Drying and curing the layer of foam compound, and (C) Tufting a carpet yarn into the layer of tuftable foam compound and primary backing so that a face of yarn is provided on the upper surface of the backing material and loop backs are provided on the layer of foam compound, the tension of the carpet yarn during tufting being adjusted so that the foam compound beneath the loop backs is compressed, the foam compound adjacent the loop backs is uncompressed and the exposed surface of the loop backs are at substantially the same level as the exposed surface of the uncompressed foam compound adjacent the loop backs whereby the undersurface of said carpet product is substantially flat having only slight indentations in said foam compound adjacent each loop back.

4. The method of claim 3 further comprising:

(D) applying a thin back-coat of adhesive material to said undersurface of said foam compound and said loop backs; and (E) doctoring said adhesive material so that said adhesive material adheres to said loop backs and fills said indentations but is substantially removed from said foam compound.

* * * * *